US005127639A

United States Patent [19]

Tucker et al.

[11] Patent Number: 5,127,639

[45] Date of Patent: Jul. 7, 1992

[54] ADJUSTABLE VISE

[75] Inventors: Edwin C. Tucker; Leonard G. Lee, both of Ottawa; Francis A. McLean, Oxford Station; Timothy C. Frank, Ottawa; Lloyd Sevack; Gary W. Lacoste, both of Nepean, all of Canada

[73] Assignee: Lee Valley Tools Ltd., Ottawa, Canada

[21] Appl. No.: 663,421

[22] Filed: Mar. 1, 1991

[51] Int. Cl.[5] ..... B25B 1/02

[52] U.S. Cl. ..... 269/139; 269/183

[58] Field of Search ..... 269/181, 182, 183, 139, 269/9, 71, 77, 78

[56] References Cited

U.S. PATENT DOCUMENTS

| | | | |
|---|---|---|---|
| 651,929 | 6/1900 | Olson | 269/139 |
| 2,331,831 | 10/1943 | Gordon | 267/183 |
| 4,858,902 | 8/1989 | Hickman | 269/139 |

OTHER PUBLICATIONS

Pages 72 and 73 from the 1990/1991 Lee Valley Tools Ltd. catalog.

Pages 24, 26 and 33 from the Dec. 1989 Woodworker's Supply of New Mexicao catalog.

Chapter 10, pp. 136 to 149 of *The Workbench Book,* written by Scott Landis, published by The Taunton Press, copyright date 1987.

*Primary Examiner*—Robert C. Watson

*Attorney, Agent, or Firm*—Kilpatrick & Cody

[57] ABSTRACT

A vise for holding a workpiece, comprising a pair of generally opposed jaws having substantially planar faces, a clamping screw having at least one external thread centered around a longitudinal axis rotatably attached at one end to one of the jaws and passing through the other jaw, a clamping screw nut having at least one internal thread occupying an arc of no more than approximately 180° and having a substantially planar forward face for bearing against a substantially planar and parallel rear face of the other jaw when the clamping screw is rotated to draw the jaws together and both the forward and rear faces are oblique to the axis of the clamping screw, a rod attached to a handle that, when depressed, moves the rod so that its movement moves the nut substantially transverse to the axis of the clamping screw, a foot pedal attached to an actuator that, when the foot petal is depressed, moves the clamping nut substantially transverse to the axis of the clamping screw, at least one guide rod rigidly attached at one end to one of the jaws, and an elastic cord attached between the other end of the guide rod and the other jaw.

12 Claims, 6 Drawing Sheets

ADJUSTABLE VISE

BACKGROUND OF THE INVENTION

This invention relates to woodworking vises, particularly of the type traditionally used by patternmakers. The need for devices to hold workpieces is as old as human beings' manufacture of objects and therefore dates from the stone age. Metal workers and woodworkers have used vises for this purpose and a staggering variety of such devices have been developed. Most of those currently in use have two jaws that are drawn together by a threaded rod. One of the more sophisticated vises, widely used in the patternmaking trade, was formerly made by the Emmert Manufacturing Company and is commonly known as the "Emmert" vise. The Emmert vise was first patented in the late 1800s and has two jaws that can be rotated about the clamping screw. The Emmert vise also is hinged to the workbench, permitting the vise to be tilted up, and the front jaw can be positioned at an angle relative to the back jaw by use of a cam mechanism.

Emmert vises, because of their weight (56 to 86 pounds), require a heavy, thick, workbench top and accordingly are difficult to mount on most workbenches. In addition, the camactuated angle adjustment allows the front jaw to be pivoted in only one direction and will not permit free pivoting or automatic adjustment for irregularly shaped workpieces. The clamping screw of Emmert vises is contained within a hollow beam, which adds weight, complexity and cost and limits the working depth (throat) of the vise jaws. Furthermore, Emmert vises do not contain any quick release or hands-free release mechanism and use square bench dogs that do not automatically rotate and line up with the workpiece.

Other vises, such as those made in Great Britain by Record, are not adjustable as are Emmert vises. However, Record vises use a half nut for engaging the clamping screw to provide a quick release feature. Record vises are also lighter and easier to install than Emmert vises.

The quick release mechanism of Record vises utilizes a leaf spring attached to the half nut. Rotating a lever on the bottom of the vise front jaw acts through the leaf spring to pull the half nut out of engagement with the clamping screw, thereby permitting the front jaw to be pushed toward or pulled away from the rear jaw without rotating the vise screw. However, the quick release lever must be operated by hand and does not pull the jaws of the vise open to clear the workpiece. Because Record vises use a half clamping nut with threads that engage only 180° of the clamping screw diameter, the leaf spring must push the half nut tight against the clamping screw in order for the threads in the clamping nut to engage the clamping screw and the clamping screw and half nut use a non-standard thread cut with a square, or even slightly undercut, extra wide thrust face. Such a thread avoids creating forces that tend to separate the half nut from the clamping screw when the vise is tighten on a workpiece; however, such a thread has a sharp edge and is not suitable for use within a precision fit hole because the sharp edge would gouge the interior surface of the hole. To overcome this problem, the clamping screw of Record vises is not journaled through the rear jaw in a precision fit hole. Rather, the clamping screw passes through a hole in the rear jaw that is substantially larger in diameter than the clamping screw. Movement of the clamping screw within the rear jaw hole is minimized by use of an extra rigid clamping screw, guide rods that slide within more precision fitted holes in the rear jaw, and a rigid connector between the clamping screw and the guide rods at the free end. While this system works well, it adds complexity, weight and cost to the resulting vise. Record vises also use square bench dogs which have the same limitations as the bench dogs used on Emmert vises.

BRIEF SUMMARY OF THE INVENTION

The present invention improves prior vises by providing an adjustable vise that is light, easy to mount on a variety of workbenches, simple to manufacture and operate and contains a quick release feature that can be operated either by hand or by foot and that variably springs the jaws of the vise open to release the workpiece. It includes a front jaw and a rear jaw connected by a clamping screw and two guide bars spaced on either side, parallel to and slightly above the clamping screw. The front jaw can be either fixed or allowed to freely pivot from side to side about its vertical centerline.

The rear jaw is fixed in a position normal to the clamping screw and has a cylindrical extension on its rear face. A split yoke having a bore of substantially the same diameter as the rear jaw extension receives the rear jaw extension in its bore. A clamping nut with a sloping face, an elongated opening, threads formed only on the bottom of the nut and a spring is retained within the extension so that its sloping face mates with a similar face cut on the rear face of the rear jaw within the extension and the spring rests within a recess in the interior of the extension. The clamping nut is retained within the extension and the extension is retained within the yoke by a retaining plate attached to the rear of the extension to bear against the rear of the yoke. The clamping screw is rotated by a sliding T-handle on its front end and passes through a pivot block, the front jaw, a precision fit, smooth hole in the rear jaw, the clamping nut and penetrates the retaining plate. The half threads on the clamping nut are held in contact with the clamping screw by the spring and the sloping faces on the clamping nut and the rear jaw. As the jaws are tightened about a workpiece, the sloping face of the clamping nut engages with the sloping thrust face on the rear jaw extension thereby introducing a force vector acting on the nut perpendicular to the screw and resisting nut movement that would disengage the nut from the clamping screw. Once the clamping force on the nut is relieved, the clamping nut may be quickly disengaged from the clamping screw by depressing a T-shaped handle having a rod journaled through the rear jaw, one end of which attaches to a plate that rests on the top of the clamping nut and the other end of which attaches to a press plate or handle. When the press plate or handle is pushed down, the elongated hole in the clamping nut allows the clamping nut threads to disengage down and away from the threads in the clamping screw, thereby disengaging the clamping nut half threads. In addition, the clamping nut has a lug threaded into its rear face. A lever connected by a chain or cord to a foot pedal is suspended from the bottom of the workbench above the lug when the vise is in its normal, non-rotated and upright position. Depressing the foot pedal pulls the lever down, thereby pushing down the lug and causing the clamping nut half threads to disengage from the clamping screw.

An elastic cord is looped through the guide rods and screw eyes on the retaining plate so that the cord is always in tension. This tension in the cord causes the front jaw to pull away from the rear jaw as soon as the clamping nut is disengaged from the clamping screw. The tension in the cord is adjustable to allow the jaws to open in varying amounts.

The vise is mounted on a workbench by a hinge plate, which is easily attached to the edge of a workbench. A hinge pin passes through the hinge plate and two arms protruding from the upper side of the yoke to attach the vise to the hinge plate. Because the hinge pin is easily removed, any number of hinge plates may be mounted to different workbenches to enable the vise to be easily relocated. The hinge plate and the holes in the yoke arms allow the vise to be pivoted relative to the top of the workbench so that the interior faces of the jaws are normal to the workbench top, pivoted 90° to be parallel to the workbench top, or at any position in between. Pivoting of the vise is controlled by a sliding bracket arm attached on one end to the yoke tightening feet, which are on the underside of the yoke opposite to the yoke arms, and on the other end to a stanchion mounted to the underside of the workbench. One end of the bracket arm is fixed to but freely pivots about the yoke and has a long slot that receives and slides along the stanchion bolt. Once the vise is pivoted into the proper position, the stanchion bolt is tightened, preventing further movement of the bracket arm and the yoke.

The vise can be rotated 360° about the centerline of the clamping screw by loosening the yoke tightening bolt, thereby allowing the yoke tightening feet to spread and the rear jaw extension to rotate within the yoke. Once the vise is rotated to a desired position, the yoke tightening bolt is retightened, clamping the yoke about the rear jaw extension and preventing further rotation.

Accordingly, one objective of the present invention is to provide a vise that is adjustable to grip securely objects of various shapes.

Another objective of the present invention is to provide a vise that can be easily and quickly mounted on different workbenches.

Still another object of the present invention is to provide a vise having jaws that can be pivoted about the edge of a workbench.

Another object of the present invention is to provide a vise having jaws that can be rotated to any position about the clamping screw.

A further object of the present invention is to provide a vise having jaws that can be positioned horizontally so as to act as a press.

Still another objective of the present invention is to provide a vise that has both a hand and a foot operated quick release feature.

A further objective of the present invention is to provide a vise that will variably spring open to release the workpiece.

Still another object of the present invention is to provide a vise that is relatively light and inexpensive to manufacture.

These and other objectives and advantages of the present invention will become apparent by reference to the drawings and the detailed description and claims which follow.

DETAILED DESCRIPTION OF THE DRAWINGS

Figure 1:
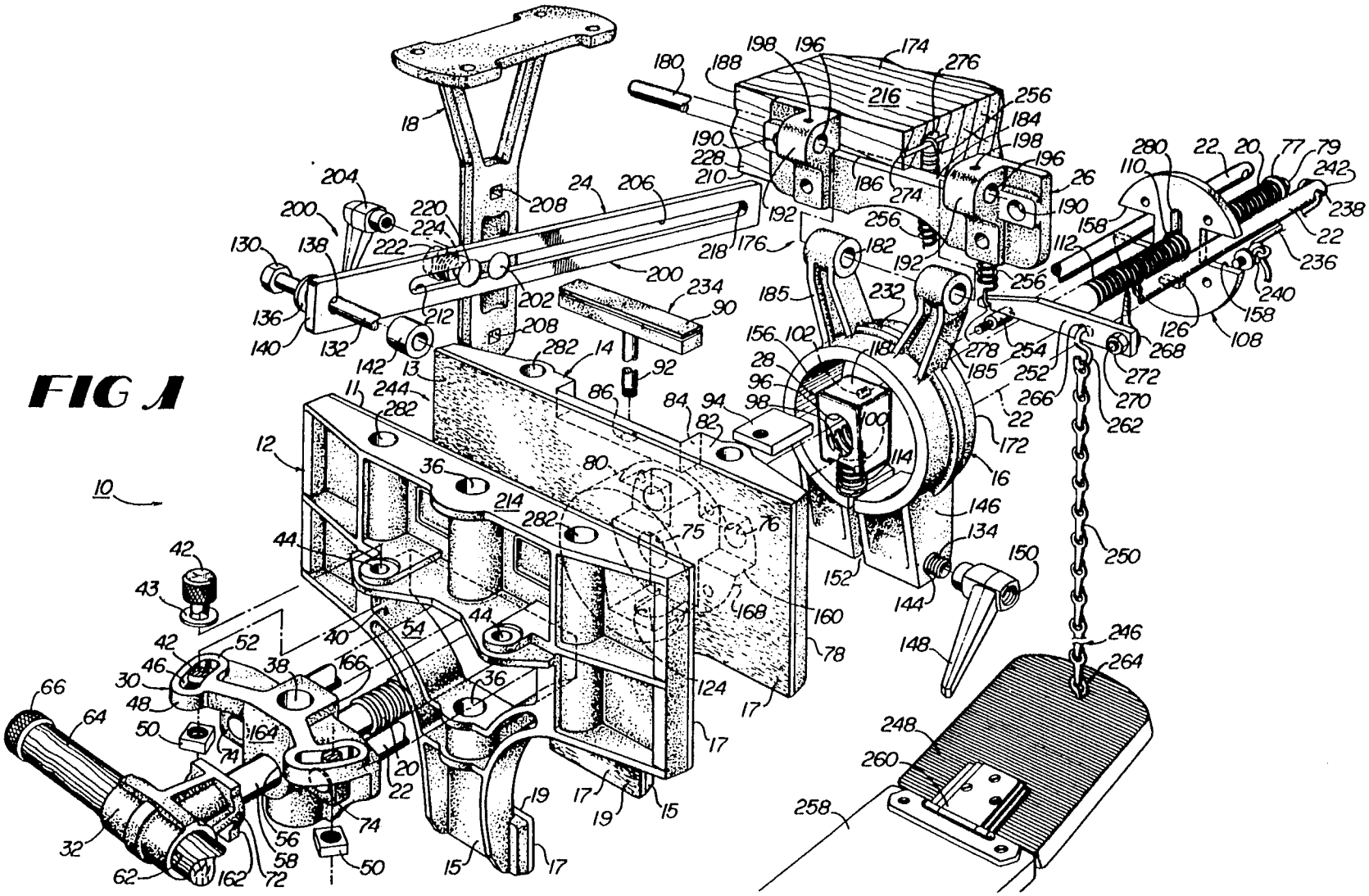
FIG. 1 is an exploded perspective view of the front of the vise of the present invention.

Vise 10 includes a front jaw 12 which moves toward or away from rear jaw 14 in order to clamp workpieces therebetween. Front jaw 12 pivots on a pivot block 30 which rides on guide rods 22 and is forced toward rear jaw 14 by clamping screw 20, which is operated by T-handle 64 and passes through pivot block 30, front jaw 12, rear jaw 14, clamping nut 28 and retainer plate 108 and is described in more detail below.

Front jaw 12 and rear jaw 14 also contain identical carver's chop jaws 15. Carver's chop jaws 15 have a smaller surface area than front jaw 12 and rear jaw 14, thereby allowing higher surface pressures to be applied to the workpiece. Carver's chop jaws 15 are of sufficient length so that when vise 10 is rotated 180°, carver's chop jaws 15 project above top surface 216 of workbench 174. Interior face 11 of front jaw 12, interior face 13 of rear jaw 14 and interior faces 19 of carver's chop jaws 15 may all contain liner 17 to prevent marring or denting of the workpiece. Liner 17 may be made of any suitable material such as rubber, cork, rubber/-cork composition or leather. Front jaw 12 and rear jaw 14 may be made of any suitable material such as steel, cast aluminum or cast iron but cast stainless steel or cast zinc-aluminum alloy (ZA-12) is preferred. ZA-12 zinc-aluminum alloy is stronger, lighter and less brittle than cast iron and also heavier, stronger and less brittle than aluminum. The low melting temperature of ZA-12 zinc-aluminum alloy permits the use of permanent molds machined from graphite. ZA-12 zinc-aluminum alloy is available, for example, from Cominco Ltd., Toronto, Ontario, Canada.

Figure 3:
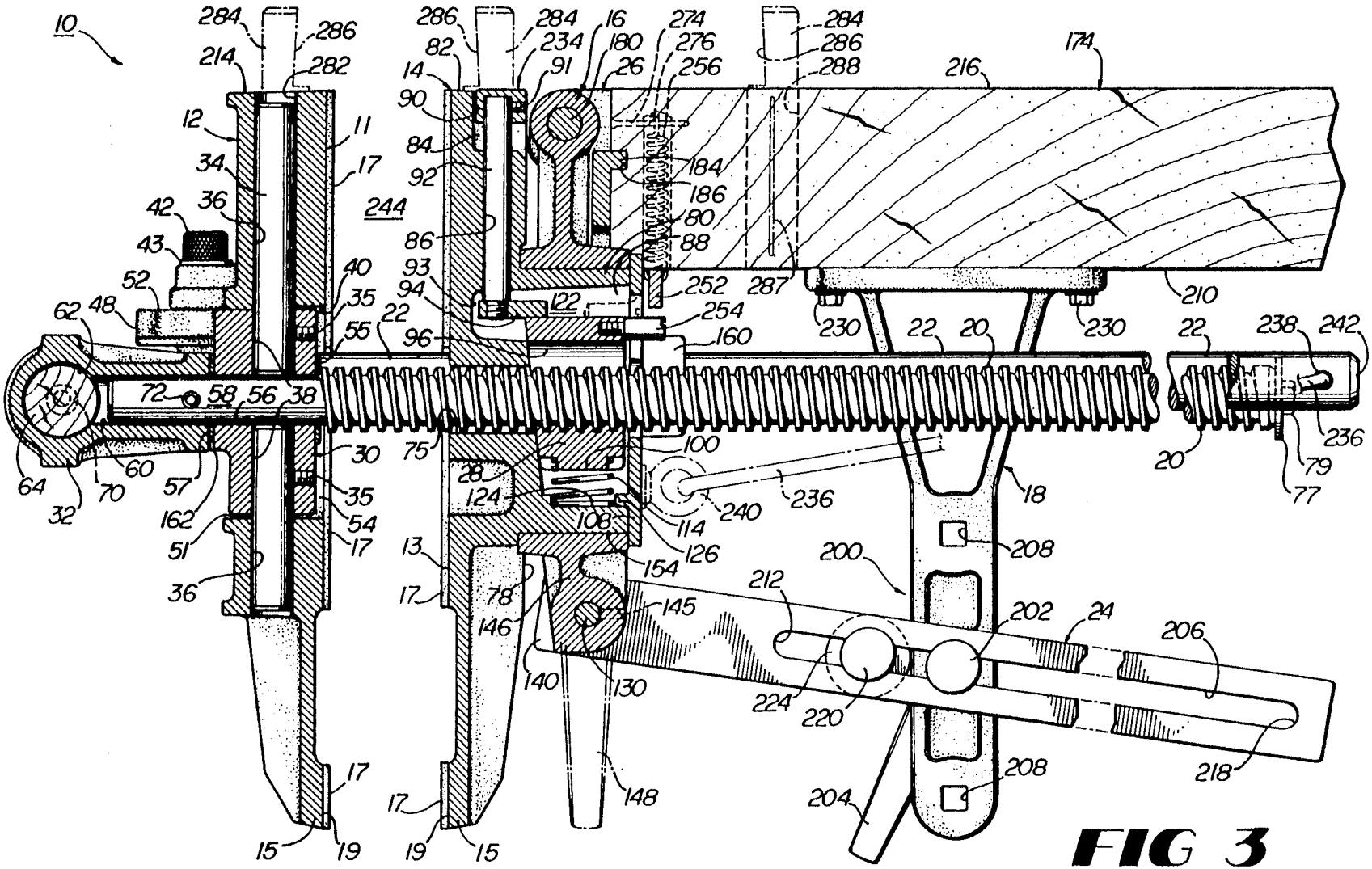
FIG. 3 is side elevation cross-section view of the vise of FIG. 1 taken through the vertical plane in which the axis of the clamping screw lies but showing the entire clamping screw in perspective.

As can be seen in FIG. 3, two hinge pins 34 pass through hole 36 in front jaw 12 and hole 38 on pivot member 30 and are held in place in pivot member 30 by setscrews 35 in order to mount front jaw 12 on pivot member 30. Two hinge pins 34 are required because clamping screw 20 also penetrates pivot member 30 through hole 56, which intersects and is normal to holes 36 and 38, thereby preventing either hinge pin 34 from penetrating the entire length of either hole 36 or 38. Pivot member 30 rests on washer 51 and a generally triangular opening 40 in front jaw 12 allows front jaw 12 to rotate on hinge pins 34. Pivot member 30 is of construction similar to front jaw 12 and rear jaw 14 and hinge pins 34 are preferably made of brass or steel.

Rotation of front jaw 12 relative to pivot member 30 is limited (for example, to a 20° arc) by screws 42, which pass through washers 43, holes 44 spaced on either side of and parallel to hole 36 in front jaw 12, and slots 46 in ears 48 of pivot member 30 and nuts 50. Tightening screws 42 within nuts 50 causes the upper surface 52 of ears 48 to frictionally engage the upper interior surface 54 of opening 40 in front jaw 12, thus fixing front jaw 12 relative to pivot member 30 and, therefore, relative to rear jaw 14. Screws 42, washers 43 and nuts 50 are preferably made of steel or brass.

Smooth portion 58 of clamping screw 20 is of smaller diameter than clamping screw threads 112, and is just long enough to journal through washer 55, hole 56 in pivot member 30, washer 57 and be frictionally received in hole 60 in handle bracket 32 so that washer 57 is sandwiched between rear face 162 of handle bracket 32 and front face 164 of pivot member 30 and washer 55 is sandwiched between clamping screw threads 112 and rear face 166 of pivot member 30. Clamping screw 20 is prevented from rotating within hole 60 by split pin 72. Handle bracket 32 also contains hole 62 which is adjacent and normal to hole 60 to receive handle 64. Handle 64 slides within hole 62 and is retained within hole 62 by stops 66 which are retained on handle 64 by screws 70. Guide rods 22 are screwed into holes 74 in pivot member 30 which are spaced equally on either side and slightly above hole 56. Guide rods 22 have a square shoulder (not shown) which seats against the rear face 166 of pivot member 30 and thereby helps to maintain guide rods 22 normal to pivot member 30. Guide rods 22 and clamping screw 20 are preferably made of rolled or turned steel or hardened steel. Handle 64 may be made of steel or any suitable hardwood such as hickory or oak. Handle bracket 62 is of construction similar to front jaw 12 and rear jaw 14.

Figure 2:
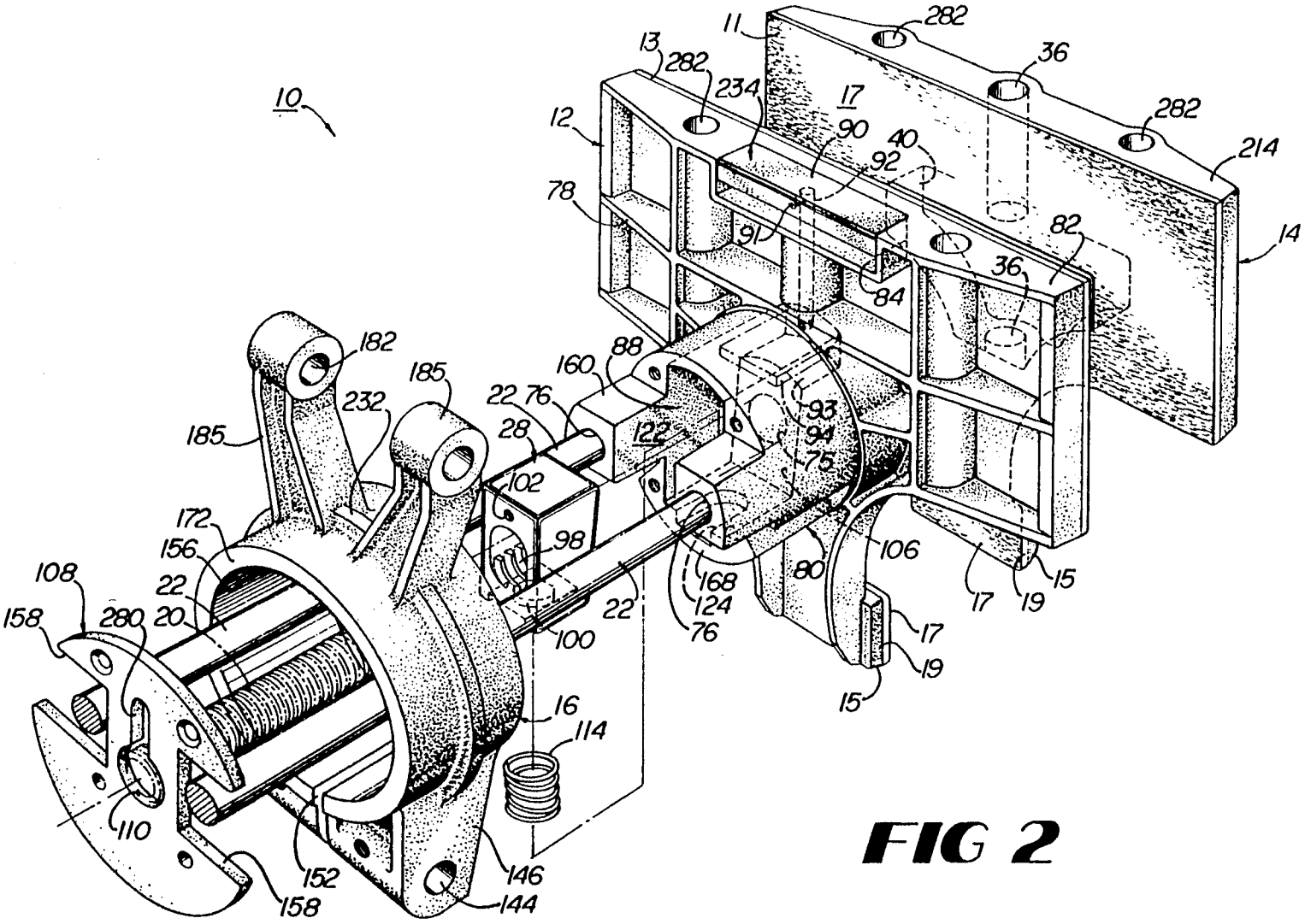
FIG. 2 is an exploded perspective view from the rear of the vise shown in FIG. 1.

As can be seen in FIGS. 1, 2 and 3, rear jaw 14 is fixed in relation to front jaw 12 and pivot block 30 by clamping screw 20, which slideably journals through hole 75 in rear jaw 14, and guide rods 22, which also slideably penetrate rear jaw 14 through parallel guide rod holes 76 extending through protrusions 160 and which are equally spaced apart from and slightly above hole 75. Guide rods 22 must be closely fitted to guide rod holes 76 to minimize skewing of guide rods 22. Placing guide rods 22 slightly above clamping screw 20 prevents the workpiece (not shown) from contacting and being damaged by clamping screw 20.

As can be seen in FIG. 2, rear face 78 of rear jaw 14 has an integrally formed, cylindrical extension 80 coaxial with clamping screw hole 75 and surrounding guide rod holes 76. Extension 80 has an exterior diameter 170 substantially the same as the diameter of bore 156 of yoke 16 and is of sufficient depth to permit the edge 168 of extension 80 to extend slightly beyond rear edge 172 of yoke 16 when extension 80 is inserted into bore 156 of yoke 16.

As can be seen in FIGS. 1 and 2, top surface 82 of rear jaw 14 contains rabbet 84 having a centrally located, perpendicular hole 86 that communicates with the interior 88 of extension 80. Rabbet 84 receives handle 90 to which a downwardly projecting rod 92 is fixed by set-screw 91. Rod 92 is prevented from escaping hole 86 by plate 94 which threads onto the end of rod 92 opposite handle 90.

Interior 88 of extension 80 also receives clamping nut 28 having an elongated hole 96, half threads 98 on the bottom of hole 96, protrusion 100 on the bottom exterior of clamping nut 28, threaded hole 102 on the rear face 104 of clamping nut 28 and a sloping front face 106. Clamping nut 28 is retained within interior 88 of extension 80 by retaining plate 108, which is of slightly larger diameter than exterior diameter 170 of extension 80, contains cutouts 158 that nest between guide rod protrusions 160 on extension 80, has a tab 126 that is received in recess 124 on the inside surface 122 of extension 80, is screwed to edge 168 of extension 80 so as to overlap edge 168 and prevent extension 80 from sliding within or out of bore 156 of yoke 16 and is of similar construction as rear jaw 14 and yoke 16. Clamping screw 20 penetrates hole 75 in rear jaw 14, hole 96 in clamping nut 28 and hole 110 in retaining plate 108 and is retained by washer 77 and bolt 79. Half threads 98 are pushed into contact with threads 112 of clamping screw 20 by spring 114, which frictionally fits on protrusion 100 of clamping nut 28 and is held in place on the inside surface 122 of extension 80 by recess 124 and tab 126 on retaining plate 108. Clamping screw threads 112 may be of any suitable design or pitch including, for instance, "Acme" class 2G with five threads per inch. Yoke 16 may be of construction similar to front jaw 12 and rear jaw 14. Clamping nut 28 may also be of similar construction or may be made of rolled or turned steel or hardened steel.

As clamping nut 28 is pushed upward by spring 114, sloping front face 106 contacts pressure face 116 on rear face 78 of rear jaw 14 in interior 88 of extension 80, and the top 118 of clamping nut 28 contacts plate 94, which is made of any suitable material such as steel. Pressure face 116 and sloping face 106 may be of any suitable angle but it is preferred that the angle 120 of pressure face 116 and front face 106 be less than the pressure angle of threads 112 and half threads 98, for instance, 5°. Such an angle 120 keeps the half threads 98 in contact with clamping screw threads 112 at all times without increasing the amount of force needed to tighten or loosen clamping screw 20 within clamping nut 28.

Yoke 16 is fixed relative to workbench top 174 by hinge assembly 176 comprised of hinge bracket 26 and hinge pin 180 that passes through holes 182 in arms 185 integrally formed with and appended from yoke 16. Bracket 26 contains weight supporting lip 184 that fits within rabbet 186 on edge 188 of workbench top 174 and is attached to edge 188 by screws (not shown) inserted through holes 190 in bracket 26. Lip 184 and rabbet 186 provide for better weight support of vise 10 and stronger attachment of vise 10 to workbench top 174. Bracket 26 also contains hinge pin eyes 192 sized and spaced so that arms 185 fit within pin eyes 192 and holes 182 in arms 185 align with holes 196 in pin eyes 192 allowing hinge pin 180 to be inserted through pin eye holes 196 and holes 182, thereby capturing arms 185 on hinge pin 180. Hinge pin 180 is prevent from escaping pin eyes 192 by setscrews 198. Hinge bracket 26 may be of construction similar to front jaw 12 and rear jaw 14.

As can be seen in FIGS. 1 and 3, yoke 16 is locked in various positions pivoting about hinge pin 180 by stanchion assembly 200, comprised of T-shaped stanchion 18, guide bracket 24, clamp bolt 202, clamp handle 204, and bolt 130. Yoke 16 attaches to bracket 24 by bolt 130 having a smooth portion 132 and a threaded portion 134. Bolt 130 threads through washer 136, hole 138 in the end 140 of guide bracket 24, spacer 142 and holes 144 in yoke feet 146 where yoke handle 148 having threaded hole 150 is received on threaded portion 134. Yoke handle 148 may be of any suitable material such as steel, stainless steel, aluminum, zinc-aluminum alloy or plastic. Bolt 130 is prevented from turning inside holes 144 by setscrew 145.

Stanchion 18 is attached to bracket 24 by bolt 202 which is inserted through slot 206 in bracket 24, one hole 208 in stanchion 18 and receives stanchion handle 204. Stanchion 18 is mounted on the underside 210 of workbench top 174 by lag screws 230 so that the front 212 of slot 206 contacts bolt 202 when the top edges 214 and 82 of front jaw 12 and rear jaw 14, respectively, are level with the top surface 216 of workbench top 174 and interior jaws faces 11, 13 and 19 are normal to workbench top 174. Alternatively, stanchion 18 is mounted so that rear 218 of slot 206 contacts bolt 202 when interior jaw faces 11, 13 and 19 are in a horizontal position parallel with workbench top 174. Stop bolt 220 is also tightened within slot 206 by nut 222 on one side or the other of bolt 202, depending upon the position of stanchion 18, so that yoke 16 does not pivot on hinge pin 180 more than 90°. Washers 224 on stop bolt 220 prevent slot ends 212 or 218 or bolt 202 from contacting and damaging nut 222. Tightening stanchion handle 204 on bolt 202 prevent slot 206 from sliding on bolt 202, thereby preventing pivoting of yoke 16 on 15 hinge pin 180. Stanchion handle 204, bolt 202, stop bolt 220, nut 222 and washers 224 may be fabricated of any suitable material such as steel, stainless steel or brass and stanchion 18 may be of construction similar to front jaw 12 and rear jaw 14.

Depending on the thickness of workbench top 174, it may be necessary to ease lower edge 228 of workbench top 174 so that apex 232 of yoke 16 and retainer 108 do not contact edge 188 of workbench top 174.

As can be seen in FIGS. 1 and 2, extension 80 of rear jaw 14, is received in bore 156 of yoke 16 and retained there by retaining plate 108. Extension 80 is prevented from rotating within bore 156 by tightening yoke handle 148 on bolt 130, which tightens yoke 16 around the exterior 154 of extension 80 and prevents rotation of extension 80. Loosening yoke handle 148 allows bore 156 to expand to its original diameter and permits extension 80 to rotate within bore 156. Because extension 80 is integrally formed in the rear face 78 of rear jaw 14, extension 80 does not move independently of rear jaw 14 but rather, the entire assembly, including rear jaw 14, handle 90, rod 92, plate 94, clamping nut 28, spring recess 124, spring 114, protrusions 160, retaining plate 108, and guide rods 22 all rotate about the 10 longitudinal axis of clamping screw 20. Front jaw 12, being fixed to pivot member 30 which is itself fixed to guide rods 22, also rotates about clamping screw 20 when rear jaw 14 is rotated.

When front jaw 12 and rear jaw 14 are rotated 90° within yoke 16, guide rods 22 are in substantially vertical, rather than horizontal, orientation with respect to clamping screw 20, with one guide rod 22 suspended substantially above clamping screw 22. Depending on the thickness of workbench top 174, it may be necessary to cut a shallow trough (not shown) in the underside 210 of workbench top 174 to allow guide rods 22 to rotate freely about clamping screw 20.

In using vise 10, handle 64 is manipulated to rotate clamping screw 20. As clamping screw 20 rotates within clamping nut 28, threads 112 engage half threads 98, thereby either drawing clamping screw 20 deeper within clamping nut 28 or backing clamping screw 20 out of clamping nut 28. As clamping screw 22 is drawn into clamping nut 28, rear face 162 of handle bracket 32 contacts front face 164 of pivot member 30, which is connected to front jaw 12 by pins 34 and screws 42, to push front jaw 12 closer to rear jaw 14. As clamping screw 20 is backed out of clamping nut 28, clamping nut 28 contacts retainer plate 108 and clamping screw threads 112 contact washer 55 which contacts rear face 166 of pivot member 30 to push pivot member 30, and consequently front jaw 12, away from rear jaw 14. To help maintain contact between clamping screw threads 112 and clamping nut 28 half threads 98 when clamping screw 20 is backed out of clamping nut 28, retainer plate 108 may have a sloping face (not shown) similar to pressure face 116 that mates with a sloping face (not shown) on the rear of clamping nut 28 similar to face 106.

Figure 4:
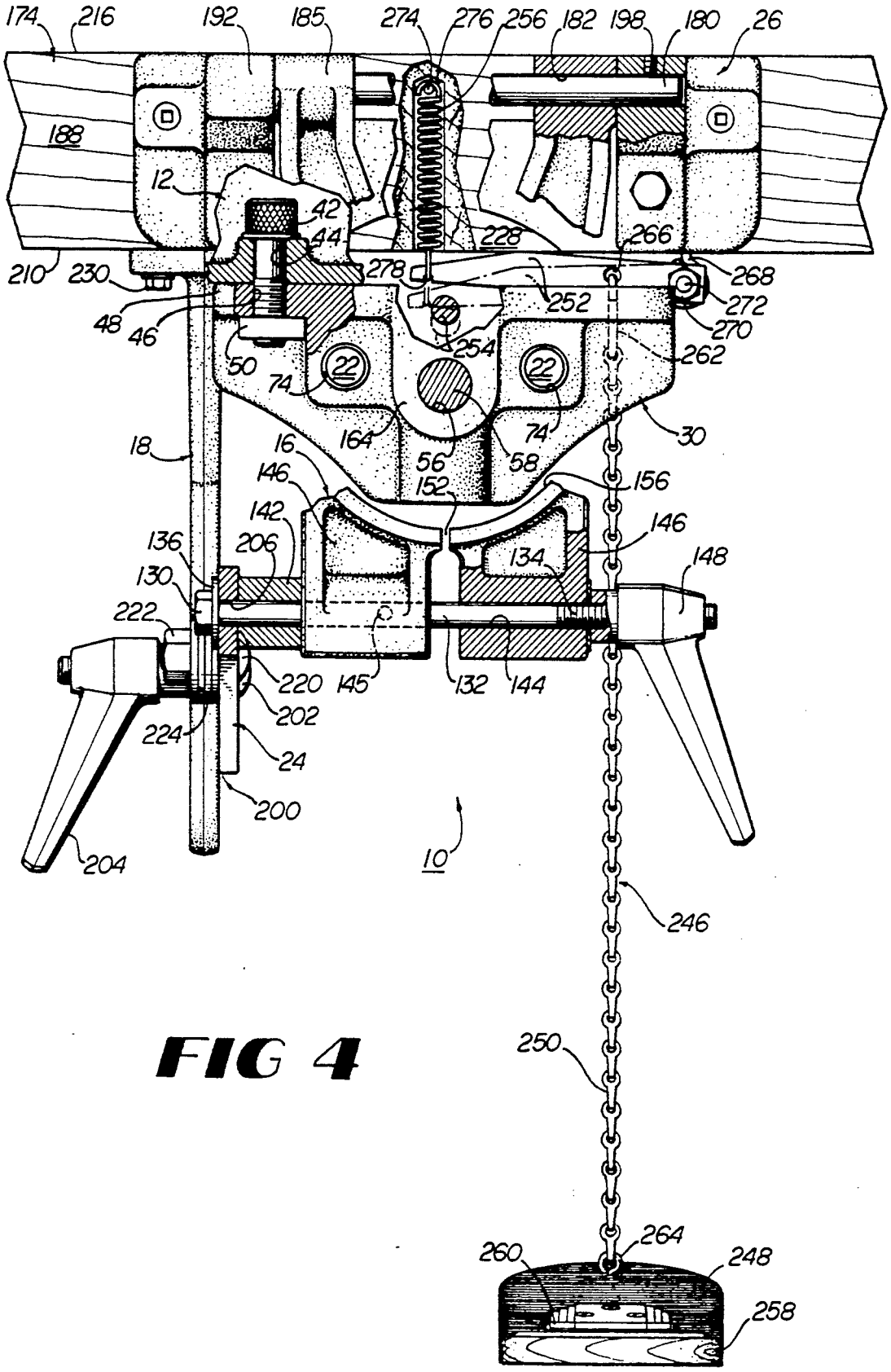
FIG. 4 is a random cross-section of the vise taken normal to FIG. 3.
Figure 5:
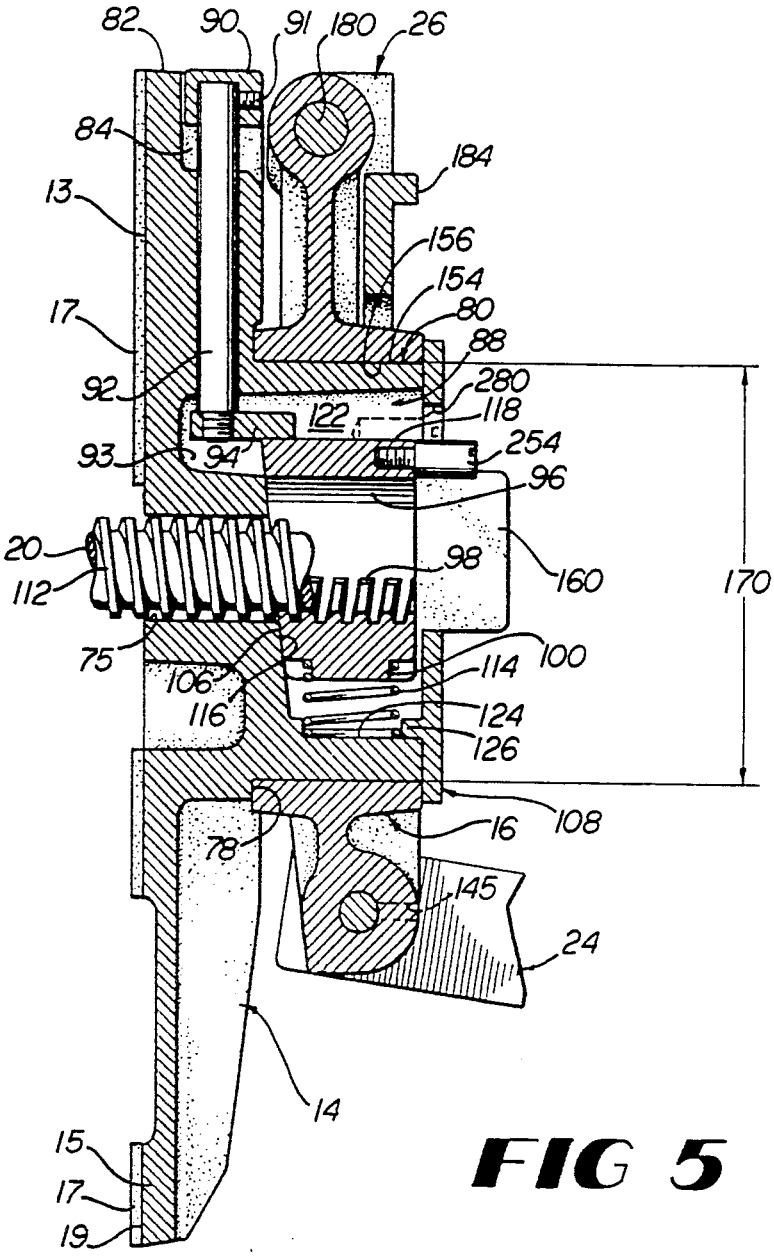
FIG. 5 is an enlarged cross section of the rear jaw of vise shown in FIG. 1.
Figure 6:
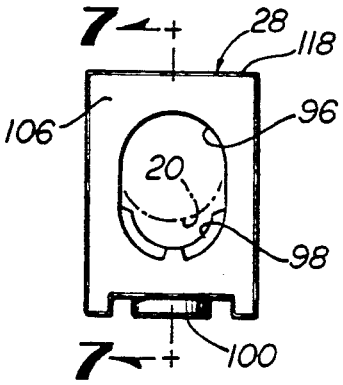
FIG. 6 is a front perspective view of the clamping nut of the vise in FIG. 1.
Figure 7:
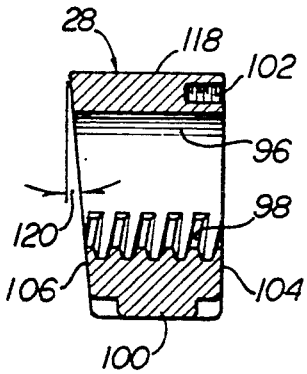
FIG. 7 is a cross section of the clamping nut of FIG. 6 taken along line 7—7.

Vise 10 also contains a hand-operated quick release assembly 234 comprised of handle 90, rod 92 and plate 94. As can be seen in FIG. 4, in its normal position, half threads 98 are maintained in contacted with clamping screw threads 112 by spring 114. In this position, the top 118 of clamping nut 28 contacts plate 94. Half threads 98 can be disengaged from clamping screw threads 112 by pushing down on handle 90, which causes rod 92 and plate 94 to push clamping nut 28 down against the force of spring 114. Because hole 96 is elongated, rod 92 and plate 94 can push clamping nut 28 down a sufficient distance so that half threads 98 disengage from clamping screw threads 112. Once clamping nut 28 is disengaged with clamping screw threads 112, clamping screw 20 can freely slide within clamping nut 28. Throat 244 of vise can then be adjusted by either pulling or pushing on handle 64, pivot block 30 or front jaw 12.

Additionally, an adjustable elastic cord 236 looped through holes 238 in the ends 242 of guide rods 22 and through screw eyes 240 screwed into retainer plate 108 can be used to cause front jaw 12 to spring open. As can be seen in FIG. 3, as front jaw 12 moves closer to rear jaw 14, thereby decreasing the size of throat 244, guide rod ends 242 slide further away from holes 76 in rear jaw 14 and, consequently, further away from retainer plate 108, which is fixed to rear jaw 14. Therefore, closing throat 244 stretches cord 236. Once clamping screw 20 is allowed to move freely by disengagement of clamping nut 28, the tension in cord 236 causes ends 242 of guide rods 22 to move toward retainer plate 108, thereby forcing front jaw 12 away from rear jaw 14 and opening throat 244 of vise 10. Looping cord 236 several times allows more even tension in cord 236 throughout the range of movement of front jaw 12. Because the tension in cord 236 is adjustable (for instance, by varying the number of loops or shortening cord 236), the movement of jaw 12 relative to jaw 14 may be adjusted by varying the tension in cord 236.

Alternatively, half threads 98 of clamping nut 28 may disengaged by foot release assembly 246, comprising foot pedal 248, chain 250, lever 252, screw eye 268, pin 274, hole 276, lug 254 and spring 256. Chain 250, lever 252, screw eye 268, pin 274, lug 254 and spring 256 may all be made of any suitable material such as steel, stainless steel or brass. Pedal 248 is attached on one end to plate 258 by hinge 260 and to chain 250 having a screw eye 264 on the other end. Chain 250 is attached to lever 252 by S-hook 262, which is inserted in hole 266 in lever 252, and is sized to raise pedal 248 relative to plate 258 when lever 252 is in its normal position. Hole 276 is sufficiently large to allow spring 256 to be received therein and is located on the underside 210 or workbench top 274 substantially plumb with clamping screw 20. Screw eye 268 is threaded into the underside 210 of workbench top 174 opposite hole 276 and further from the centerline of clamping screw 20. Lever 252 is attached on one end to screw eye 268 by bolt 270, which is journaled through screw eye 268 and retained within screw eye 268 by nut 272, and to spring 256, which is retained within hole 276 by pin 274, and attached on the other end to spring 256, which is prevented from moving off lever 252 by notch 278.

In use, spring 256 pulls up lever 252 so that lever 252 is clear of lug 254, which is threaded into hole 102 on clamping nut 28. Depressing pedal 248 pulls on chain 250, thereby pressing lever 252 into contact with lug 254. As pedal 248 continues to be pressed down, lever 252 presses down on lug 254, which travels within slot 280 in retaining plate 108, thereby causing clamping nut 28 to compress spring 114 and disengaging half threads 98 from clamping screw threads 112 in the same way as previously described above. It should be noted, however, that foot release assembly 256 will only so act to disengage clamping nut 28 when front jaw 12 and rear jaw 14 are in their normal, non-rotated and upright position. This is because as yoke 16 pivots about hinge pin 180, lug 254 pivots away from lever 252 so that movement of lever 252 will no longer press against lug 254 and disengage clamping nut 28. Likewise, rotating front jaw 12 and rear jaw 14 within bore 156 causes lug 254 to rotate away from lever 252.

As can be seen in FIGS. 1, 2 and 3, top surface 214 of front jaw 12 and top surface 82 of rear jaw 14 also contain holes 282 to receive bench dogs 284. Bench dogs 284 are round and contain flat surfaces 286 and side springs 287. In use, bench dogs 284 rotate within hole 282 to allow flat portions 286 to automatically rotate and line up with the workpiece. Side springs 287 prevent bench dogs 284 from falling back into holes 282 once bench dogs 284 have been raised. Additional holes 288 for bench dogs 284 can be drilled in workbench top 174 to allow vise 10 to hold workpieces larger than those that can be retained within throat 244.

Figure 8:
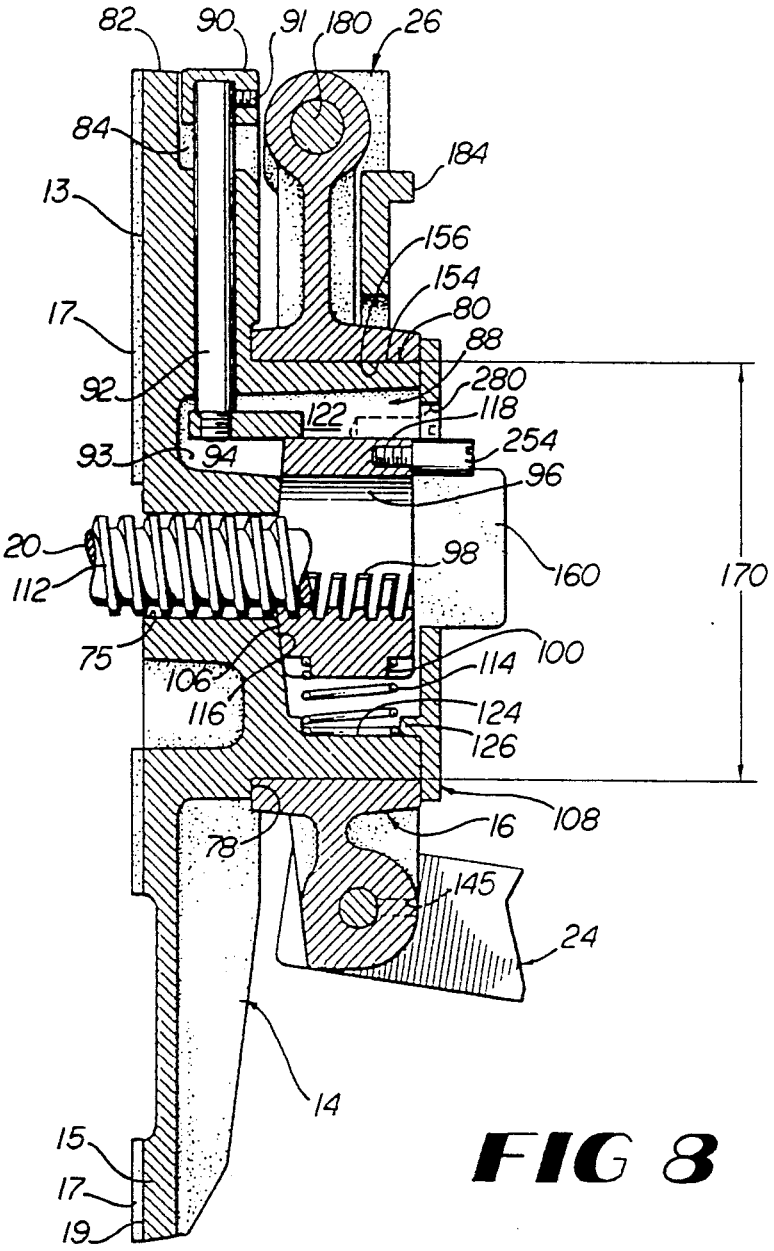
FIG. 8 is an enlarged cross section of the rear jaw of a second embodiment of the vise of the present invention and similar to FIG. 5.
Figure 9:
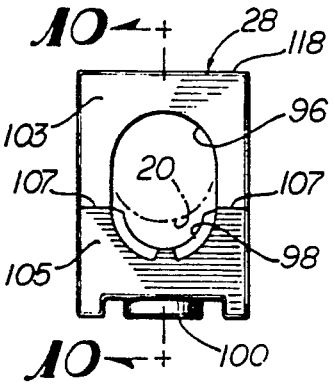
FIG. 9 is a front perspective view of the clamping nut of the embodiment of the present invention shown in FIG. 8 and similar to FIG. 6.
Figure 10:
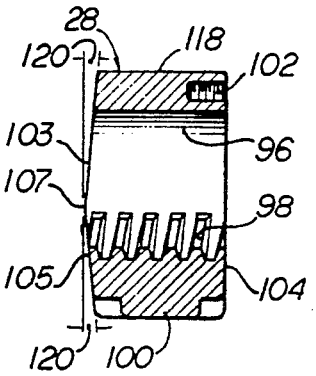
FIG. 10 is a cross section of the clamping nut of FIG. 9 taken along line 10—10.

In a second embodiment of the present invention, illustrated in FIGS. 8, 9 and 10, face 106 of clamping nut 28 is not a continuous plane. Instead, face 106 lies in two planes, 103 and 105, that intersect along line 107 at a right angle to the axis of clamping screw 28 and at angle 120 from vertical. Pressure face 116 on rear face 78 of rear jaw 14 presents mating surfaces 115 and 117 that nest with planes 103 and 105, respectively. Use of opposing planes 103 and 105 holds clamping nut 28 centered about hole 75 and helps prevents excessive movement of clamping nut 28 within interior 88 of extension 80. This description is given for purposes of illustration and explanation. It will be apparent to those skilled in the relevant art that modifications and changes may be made to the invention as described above without departing from its scope and spirit. The materials described herein are illustrative only. Those skilled in the art will recognize that other suitable materials, whether known now or in the future, can be substituted for the materials described herein.

We claim:

1. An adjustable vise for mounting on an edge of a workbench having a top surface and a bottom surface, comprising:

(a) a pair of generally opposed jaws having substantially planar faces;

(b) a means for forcing the jaws toward each other and for maintaining their relative position in order to clamp a workpiece therebetween;

(c) a means for simultaneously rotating both jaws about an axis normal to the face of at least one of the jaws and locking the jaws in any angular position about that axis;

(d) a means for tilting both jaws through an arc of at least 90° and for locking the jaws in any position along that arc;

(e) a means for pivoting one of the jaws relative to the other so that the planar faces may be positioned alternatively in parallel or nonparallel orientations;

(f) a means for selectively locking the pivotable jaw in any of the parallel or nonparallel orientations to which it may be pivoted; and (g) a means for releasing the jaws forcing and maintaining means so that the position of the jaws relative to each other may be rapidly changed in order to open or close the jaws.

2. The vise of claim 1 wherein a) the jaws forcing and maintaining means comprises:

i) a clamping screw having at least one external thread centered around a longitudinal axis;

ii) a clamping screw nut having at least one internal thread occupying an arc of on no more than approximately 180°; and b) the releasing means comprises a means for displacing the nut relative to the clamping screw so that the nut thread disengages from the screw thread.

3. The vise of claim 2 wherein the clamping nut has a forward face that bears against a rear face of one of the jaws when the forcing and maintaining means is operated and both the forward and rear faces are substantially planar, substantially parallel and oblique to the axis of the clamping screw.

4. The vise of claim 2 wherein the displacing means comprises a rod attached to a handle that, when depressed, moves the rod so that its movement moves the nut substantially transverse to the axis of the clamping screw.

5. The vise of claim 2 wherein the displacing means comprises a foot petal attached to an actuator that, when the foot petal is depressed, moves the nut substantially transverse to the axis of the clamping screw.

6. The vise of claim 1 further comprising a means for automatically separating the jaws when the releasing means is actuated.

7. An adjustable vise for mounting on an edge of a workbench having a top surface and a bottom surface, comprising:

(a) a pair of generally opposed jaws having substantially planar faces;

(b) a means for forcing the jaws toward each other end for maintaining their relative position in order to clamp a workpiece therebetween;

(c) a means for simultaneously rotating both jaws about an axis normal to the face of at least one of the jaws and locking the jaws in any angular position about that axis;

(d) a means for tilting both jaws through an arc of at least 90° and for locking the jaws in any position along that arc;

(e) a means for pivoting and locking one of the jaws relative to the other so that the planar faces may be positioned alternatively in parallel or nonparallel orientations;

(f) a means for releasing the jaws forcing and maintaining means so that the position of the jaws relative to each other may be rapidly changed in order to open or close the jaws;

(g) a means for automatically separating the jaws when the releasing means is actuated; and (h) at least one guide rod rigidly attached at one end to one of the jaws and wherein the releasing means comprises an elastic cord attached between the other end of the guide rod and the other jaw.

8. A vise for holding a workpiece, comprising:

a) a pair of generally opposed jaws having substantially 3 planar faces;

b) a means for forcing the jaws toward each other and for maintaining their relative position in order to clamp a workpiece therebetween comprising i) a clamping screw rotatably attached at one end to one of the jaws and passing through the other jaw to engage a clamping nut having at least one internal thread occupying an arc of no more than approximately 180°.

ii) the clamping nut further having a substantially planar forward face for bearing against a substantially planar and parallel rear face of the other jaw when the clamping screw is rotated to draw the jaws together and both the forward and rear faces are oblique to the axis of the clamping screw.

9. A device having an axis, comprising:

a) a first member;

b) a second member i) having a bearing surface oriented oblique to the axis and ii) movable relative to the first member along the axis by means of rotation of c) a screw that bears at one end of the screw against the first member and engages d) a nut having i) at least one internal thread occupying an arc of no more than approximately 180° so that the thread may be disengaged from the screw by movement of the nut transverse to the axis and ii) a substantially planar face for bearing against the bearing surface of the second member when the clamping screw is rotated so that the nut will not move transverse to the axis and disengage from the screw when the screw is rotated and the nut face bears against the bearing surface.

10. A vise for holding a workpiece, comprising:

(a) a pair of generally opposed jaws having substantially planar faces;

(b) a means for forcing the jaws toward each other and for maintaining their relative position in order to clamp a workpiece therebetween comprising (i) a clamping screw rotatably attached at one end to one of the jaws and passing through the other jaw to engage a clamping nut having at least one internal thread occupying an arc of no more than approximately 180°;

(ii) the clamping nut further having a substantially planar forward face for bearing against a substantially planar and parallel rear face of the other jaw when the clamping screw is rotated to draw the jaws together and both the forward and rear faces are oblique to the axis of the clamping screw;

(c) a rod attached to a handle that, when depressed, moves the rod so that its movement moves the nut substantially transverse to the axis of the clamping screw;

(d) a foot petal attached to an actuator that, when the foot petal is depressed, moves the nut substantially transverse to the axis of the clamping screw;

(e) at least one guide rod rigidly attached to one end to one of the jaws; and (f) an elastic cord attached between the other end of the guide rod and the other jaw.

11. An adjustable vise for mounting on an edge of a workbench having a top surface and a bottom surface, comprising:

(a) a pair of generally opposed jaws having substantially planar faces;

(b) a means for forcing the jaws toward each other and for maintaining their relative position in order to clamp a workpiece therebetween;

(c) a means for simultaneously rotating both jaws about an axis normal to the face of at least one of the jaws and locking the jaws in any angular position about the axis;

(d) a means for tilting both jaws through an arc of at least 90° and for locking the jaws in any position along that arc comprising:

(i) a hinge plate having eyes mounted on the edge of the workbench;

(ii) a stanchion having a hole mounted on the bottom surface of the workbench;

(iii) a bracket having a hold and a slot;

(iv) a yoke having arms and feet suspended from the workbench edge by a hinge pin journaled through the hinge plate eyes and holes in the yoke arms;

(v) a first bolt that journals through the bracket hole and holes in the yoke feet and receives a nut; and (vi) a second bolt that journals through the stanchion hole and the bracket slot and receives a nut so that the slot slides along the second bolt;

(e) a means for pivoting and locking one of the jaws relative to the other so that the planar faces may be positioned alternatively in parallel or nonparallel orientations; and (f) a means for releasing the jaws forcing and maintaining means so that the position of the jaws relative to each other may be rapidly changed in order to open or close the jaws.

12. The vise of claim 11 wherein the means for rotating and locking the jaws comprises:

a) a bore in the yoke;

a) a cylindrical projection on one of the jaws that is received and retained in the yoke bore; and b) a means for tightening the bore around the projection.

* * * * *